US011859899B2

(12) United States Patent
Xu

(10) Patent No.: US 11,859,899 B2
(45) Date of Patent: Jan. 2, 2024

(54) REFRIGERATOR

(71) Applicants: QINGDAO HAIER REFRIGERATOR CO., LTD., Shandong (CN); HAIER SMART HOME CO., LTD., Shandong (CN)

(72) Inventor: Zhiguo Xu, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 73 days.

(21) Appl. No.: 17/611,800

(22) PCT Filed: Apr. 30, 2020

(86) PCT No.: PCT/CN2020/088250
§ 371 (c)(1),
(2) Date: Nov. 16, 2021

(87) PCT Pub. No.: WO2020/228548
PCT Pub. Date: Nov. 19, 2020

(65) Prior Publication Data

US 2022/0243979 A1 Aug. 4, 2022

(30) Foreign Application Priority Data

May 16, 2019 (CN) ..... 201920708438.3

(51) Int. Cl.
*F25D 27/00* (2006.01)

(52) U.S. Cl.
CPC ..... *F25D 27/00* (2013.01)

(58) Field of Classification Search
CPC ..... F25D 27/00; F25D 27/005; F25D 2327/00
See application file for complete search history.

(56) References Cited

U.S. PATENT DOCUMENTS 8,186,844 B2 * 5/2012 Hall ..... F25D 27/00 362/127
8,443,617 B2 * 5/2013 Park ..... F25D 27/00 62/133

(Continued)

FOREIGN PATENT DOCUMENTS

CN 202304234 U 7/2012
CN 103123201 A 5/2013

(Continued)

OTHER PUBLICATIONS

International Search Report for PCT/CN2020/088250 (ISA/CN) dated Jun. 24, 2020 with English translation (6 pages).

(Continued)

*Primary Examiner* — Andrew M Roersma
(74) *Attorney, Agent, or Firm* — Alston & Bird LLP

(57) ABSTRACT

A refrigerator (100), comprising: a cabinet (110), having at least one storage compartment (140) defined therein, and having side walls (114); and a light source (500), which is disposed at the side wall (114), and configured such that light emitted by the light source (500) obliquely propagates backwards inside the box body (110), so as to provide illumination for the at least one storage compartment (140). According to the refrigerator (100), the light source (500) is provided at the side wall (114) of the cabinet (110), and light emitted by the light source (500) obliquely propagates backwards inside the cabinet (110) to provide illumination for the storage compartment (140); thus, illumination for the storage compartment (140) would not be affected by a shelf, and the light propagates backwards so that no dazzling occurs to the user's visual experience.

6 Claims, 7 Drawing Sheets

(56) References Cited

U.S. PATENT DOCUMENTS

| | | | | |
|---|---|---|---|---|
| 8,459,818 | B2 * | 6/2013 | Becke | F25D 27/00 362/92 |
| 2012/0106129 | A1 * | 5/2012 | Glovatsky | F25D 23/067 362/92 |
| 2012/0312798 | A1 * | 12/2012 | Aoki | F25D 27/00 219/220 |
| 2013/0128494 | A1 * | 5/2013 | Seo | F25D 27/00 362/92 |
| 2019/0017679 | A1 * | 1/2019 | Choi | F25D 23/065 |
| 2019/0339003 | A1 * | 11/2019 | Signorino | F25D 27/00 |
| 2021/0088271 | A1 * | 3/2021 | Hanson | F21V 15/01 |
| 2022/0049845 | A1 * | 2/2022 | Kim | G02B 6/0065 |

FOREIGN PATENT DOCUMENTS

| | | | |
|---|---|---|---|
| CN | 105222514 | A | 1/2016 |
| DE | 102015114461 | A1 * | 3/2017 |
| JP | 2008039357 | A | 2/2008 |
| JP | 2008070080 | A | 3/2008 |
| TW | 541480 | B | 7/2016 |
| WO | WO 2010/099038 | A2 | 9/2010 |
| WO | WO-2018164030 | A1 * | 9/2018 |

OTHER PUBLICATIONS

Written Opinion of the International Searching Authority for PCT/CN2020/088250 (ISA/CN) dated Jun. 24, 2020 with English translation (7 pages).

1st Examination Report for Australia Patent Application No. 2020275125 dated Sep. 6, 2022 (3 pages).

Notice of Acceptance for Australia Patent Application No. 2020275125 dated Jan. 3, 2023 (3 pages).

1st Examination Report for New Zealand Patent Application No. 780617 dated May 22, 2023 (6 pages).

2nd Examination Report for New Zealand Patent Application No. 780617 dated Sep. 12, 2023 (6 pages).

* cited by examiner

REFRIGERATOR

FIELD OF THE INVENTION

The present invention relates to the technical field of refrigerating and freezing device, and in particular relates to a refrigerator.

BACKGROUND OF THE INVENTION

A fruit and vegetable box drawer in a refrigerator is usually disposed at the lower part of a refrigerating compartment, and the problem of insufficient lighting is caused due to the fact that the fruit and vegetable box drawer is shielded by a shelf at the upper portion and a gray liner of a cabinet does not reflect light. In the prior art, a lamp bar is vertically disposed on the side wall of the cabinet to irradiate the interior of the drawer, and seen from the outside of the cabinet, dazzling occurs to visual experience.

BRIEF DESCRIPTION OF THE INVENTION

An object of the present invention is to provide a refrigerator of which the illumination for a storage compartment is not affected by a shelf and which is not dazzling.

A further object of the present invention is to achieve full illumination in the left-right direction of the storage compartment.

The other further object of the present invention is to provide a refrigerator with a light source which is convenient to replace.

Specifically, the present invention provides a refrigerator, including:

- a cabinet, having at least one storage compartment defined therein, and having side walls; and
- a light source disposed on the side wall, and configured such that light emitted by the light source obliquely propagates backwards inside the cabinet, so as to provide illumination for the at least one storage compartment.

Optionally, the light source is configured such that an included angle between the light emitted and the side wall is 45°-65°.

Optionally, the light source is disposed close to front end of the side wall.

Optionally, the side walls include a left side wall and a right side wall; the light sources are disposed on the corresponding left side wall and right side wall of the at least one storage compartment respectively; and the inclination angles of the light emitted by the light source positioned on the left side wall and the light source positioned on the right side wall meet the condition that the light on the two sides at least partially intersect, so that full illumination in the left-right direction of the storage compartment is realized.

Optionally, the refrigerator further includes side wall plates detachably and fixedly connected with the side walls; and the light source is disposed on the side wall plate.

Optionally, a concave structure is formed on the side wall plate, and has a first inclined portion, a second inclined portion, a top surface portion and a bottom surface portion, where the first inclined portion is disposed close to the front side of the cabinet, the second inclined portion is disposed away from the front side of the cabinet, the first inclined portion and the second inclined portion intersect, the top surface portion is disposed at the tops of the two inclined portions, and the bottom surface portion is disposed at the bottoms of the two inclined portions; and the light source is disposed at the first inclined portion.

Optionally, the included angle between the first inclined portion and the second inclined portion is a right angle or an obtuse angle.

Optionally, a mounting opening is provided in the first inclined portion.

The refrigerator further includes a lampshade which is of a light-transmitting structure and fixed to the mounting opening; and a lamp holder fixed to the lampshade, where an accommodating cavity is formed between the lamp holder and the lampshade, and the light source is disposed in the accommodating cavity.

Optionally, the lampshade is provided with an inner-layer plate and an outer-layer plate, where the inner-layer plate is disposed in the mounting opening, and the outer-layer plate covers the mounting opening; the inner-layer plate is fixed to the back surface of the first inclined portion; the lamp holder is fixed to the back surface of the inner-layer plate, and the accommodating cavity is formed therebetween.

Optionally, the lamp holder includes a base body and a control block, where the light source is disposed on a front surface of the base body, the control block is disposed at the bottom; and the light source is controlled by the control block.

According to the refrigerator of the present invention, the light source is disposed on the side wall of the cabinet, and the light emitted by the light source obliquely propagates backwards inside the cabinet to provide illumination for the storage compartment, so that the illumination for the storage compartment is not affected by the shelf, and meanwhile, the light propagates backwards so that no dazzling occurs to the user's visual experience.

Furthermore, the light sources are disposed on the left side wall and the right side wall of the storage compartment respectively, and the light emitted by the light sources at least partially intersect, so that full illumination in the left-right direction of the storage compartment is achieved.

Furthermore, the light source is disposed on the side wall plate which is detachably and fixedly connected with the side wall, so that the light source is convenient to replace.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION

In the description below, orientation or position relations indicated by the terms "front", "back", "on/above", "under/below", "left", "right" and the like are orientations based on the refrigerator 100 itself as a reference, and "front", "back", "left", and "right" are directions indicated in FIG. 2.

Figure 1:
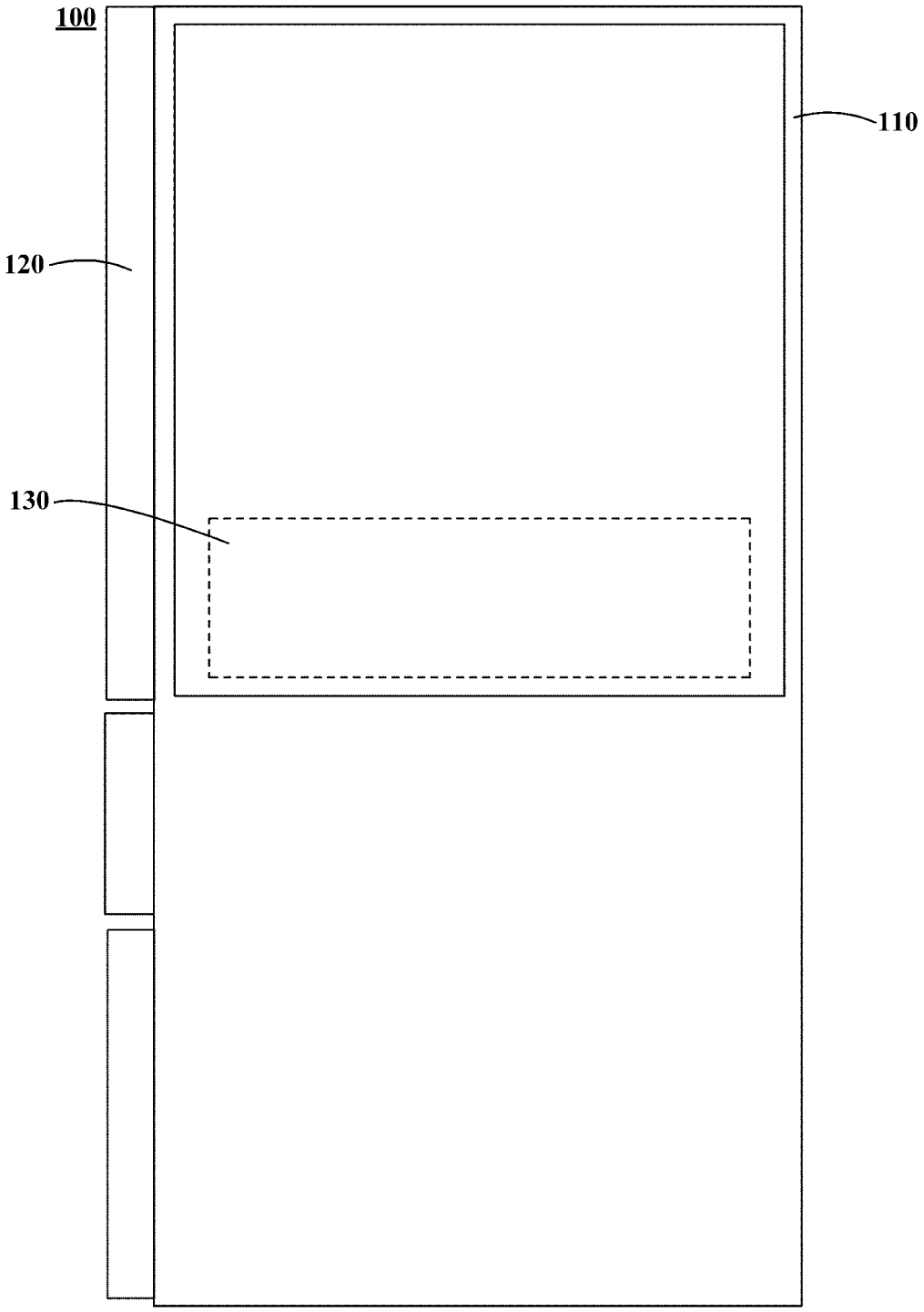
FIG. 1 is a schematic side view of a refrigerator according to one embodiment of the present invention.

FIG. 1 is a schematic side view of a refrigerator 100 according to one embodiment of the present invention. The refrigerator 100 provided by the present invention generally includes a cabinet 110, a door body and a light source 500. At least one storage compartment 140 is defined inside the cabinet 110. The number and configuration of the storage compartment 140 may be configured as needed. For example, FIG. 1 illustrates a first storage compartment, a second storage compartment, and a third storage compartment disposed in sequence from top to bottom, where the first storage compartment has a rotationally-opened door body 120 disposed on a front side of the cabinet 110 for closing the storage compartment; the second storage compartment and the third storage compartment are drawer type storage devices and are disposed in the storage compartments in a drawing mode. The storage compartment 140 may be configured as a refrigerating compartment, a freezing compartment, a temperature-variable compartment, or a fresh-keeping compartment according to different purposes. Each storage compartment 140 may be divided into a plurality of storage areas by a shelf, and the shelf or drawers 130 are used for storing articles. The refrigerator 100 provided by the embodiment of the present invention may be a typical French refrigerator in which three compartments, a refrigerating compartment, a freezing compartment and a freezing compartment, are sequentially disposed from top to bottom.

Figure 2:
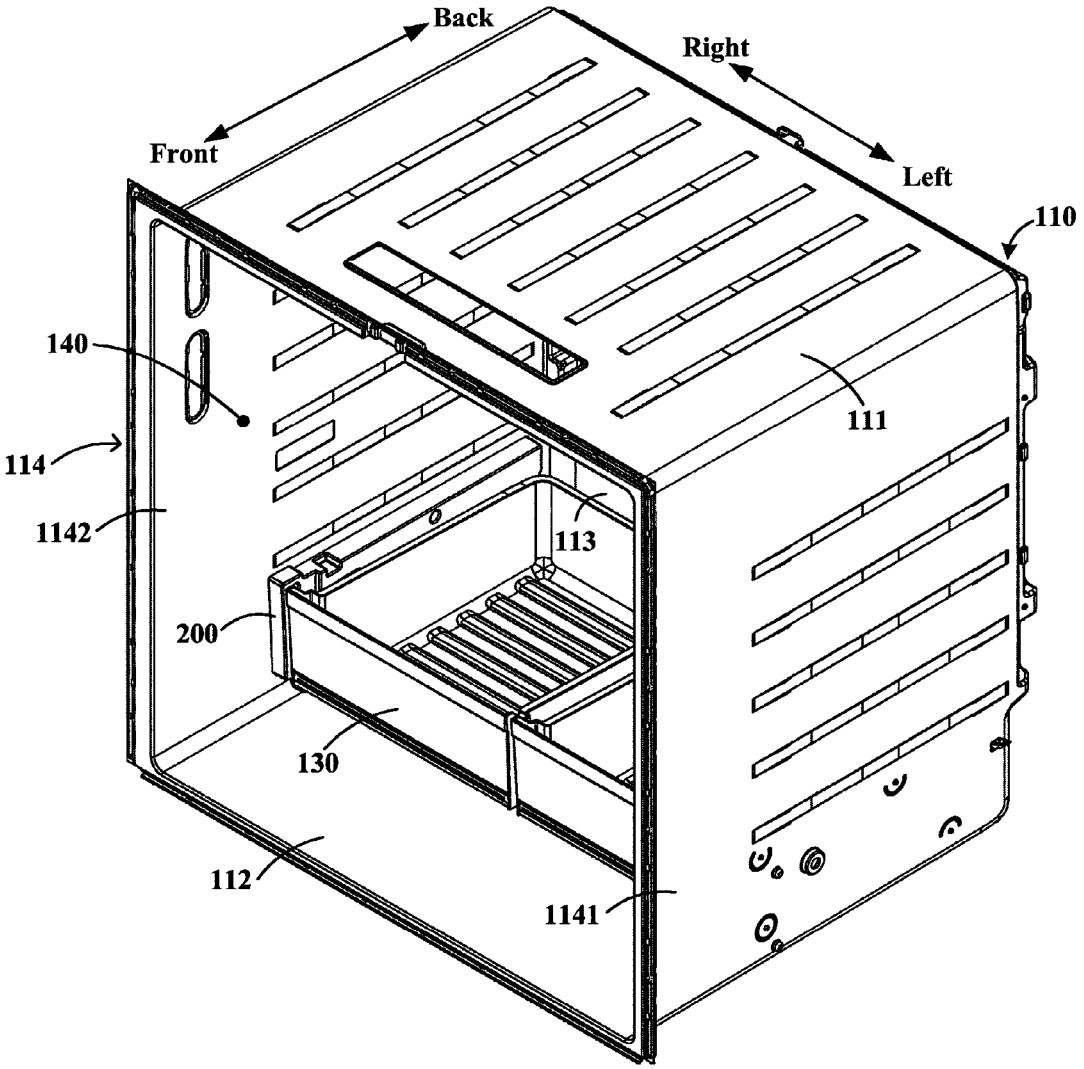
FIG. 2 is a schematic three-dimensional view of a partial cabinet of the refrigerator shown in FIG. 1.

FIG. 2 is a schematic three-dimensional view of a partial cabinet 110 of the refrigerator 100 shown in FIG. 1. Taking the refrigerating compartment as an example, the cabinet 110 corresponding to the refrigerating compartment includes side walls 114, a top wall 111, a bottom wall 112 and a rear wall 113, wherein the side walls 114 including a left side wall 1141 and a right side wall 1142. A light source 500 is disposed on the side wall 114, and is configured such that light emitted by the light source obliquely propagates backwards inside the cabinet 110, so as to provide illumination for the refrigerating compartment. According to the refrigerator 100 provided by the embodiment of the present invention, the light source 500 is disposed on the side wall 114 of the cabinet 110, and the light emitted by the light source 500 obliquely propagates backwards inside the cabinet 110 to provide illumination for the storage compartment 140, so that the illumination for the storage compartment 140 is not affected by the shelf, and meanwhile, the light propagates backwards so that no dazzling occurs to the user's visual experience.

In some embodiments, the light sources 500 are disposed on the left side wall 1141 and the right side wall 1142 respectively, and the inclination angles of the light emitted by the light source 500 positioned on the left side wall 1141 and the light source 500 positioned on the right side wall 1142 meet the condition that the light on the two sides at least partially intersect, so that full illumination in the left-right direction of the refrigerating compartment is realized. In some embodiments, the light source 500 is configured such that an included angle between the light emitted and the side wall 114 is 45°-65°, for example, 55°.

In some embodiments, to achieve substantially full illumination in the front-rear direction of the refrigerating compartment, the light sources 500 are disposed close to front ends of the left side wall 1141 and the right side wall 1142.

The refrigerator 100 provided by the embodiment of the present invention further includes side wall plates 200. The side wall plates 200 are detachably and fixedly connected with the side walls. The light source 500 is disposed on the side wall plate 200. According to the embodiment of the present invention, the light source 500 is disposed on the side wall plate 200 which is detachably and fixedly connected with the side wall 114, so that the light source 500 is convenient to replace.

Figure 3:
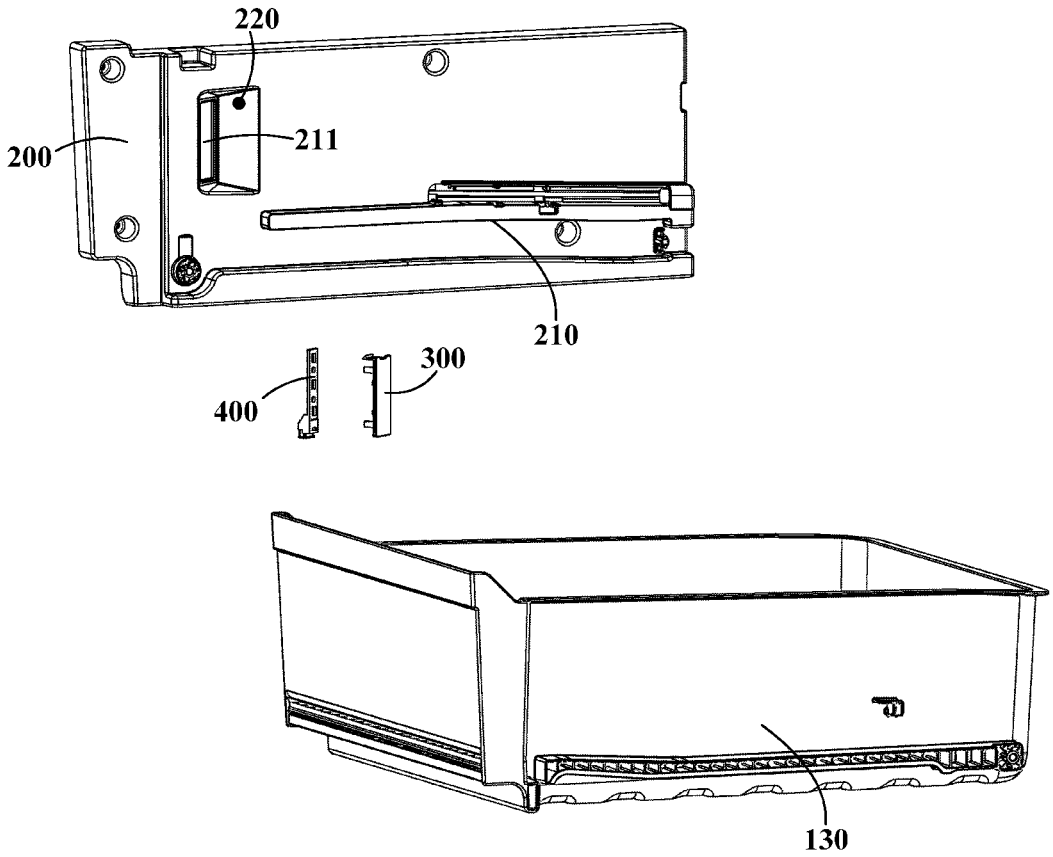
FIG. 3 is a schematic exploded view of a drawer, a side wall plate, a lampshade and a lamp holder of the refrigerator shown in FIG. 2.

FIG. 3 is a schematic exploded view of a drawer 130, a side wall plate 200, a lampshade 300 and a lamp holder 400 of the refrigerator 100 shown in FIG. 2. As shown in FIG. 2 and FIG. 3, the refrigerator 100 provided by the embodiment of the present invention is provided with a light-transmitting fruit and vegetable box drawer 130 at the bottom of the refrigerating compartment. The drawer 130 moves along slideways 210 on slideway 210 plates 200 to achieve forward and backward movement inside the refrigerator 100. At this time, the slideway plates 200 serve as the side wall plates 200 to provide a required mounting position for the light source 500.

Figure 4:
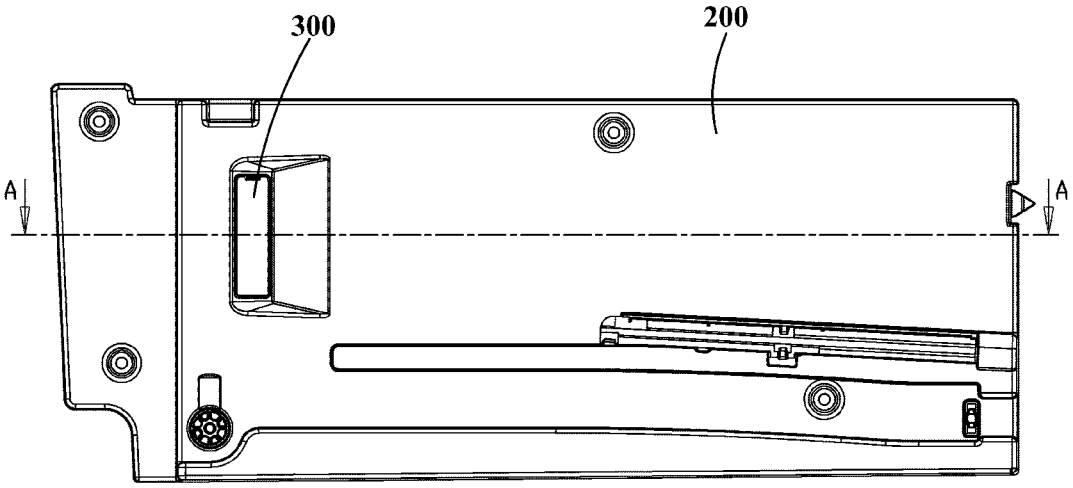
FIG. 4 is a schematic front view of a side wall plate, a lampshade and a lamp holder of the refrigerator shown in FIG. 2.
Figure 5:
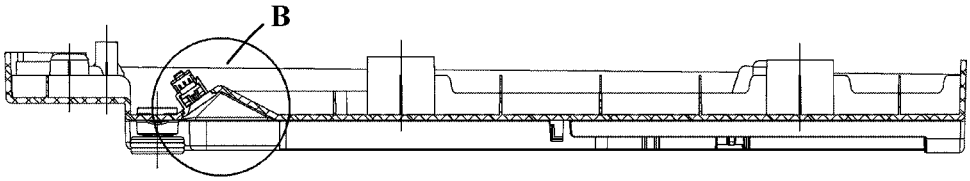
FIG. 5 is a schematic cross-sectional view taken by a section line A-A in FIG. 4.
Figure 6:
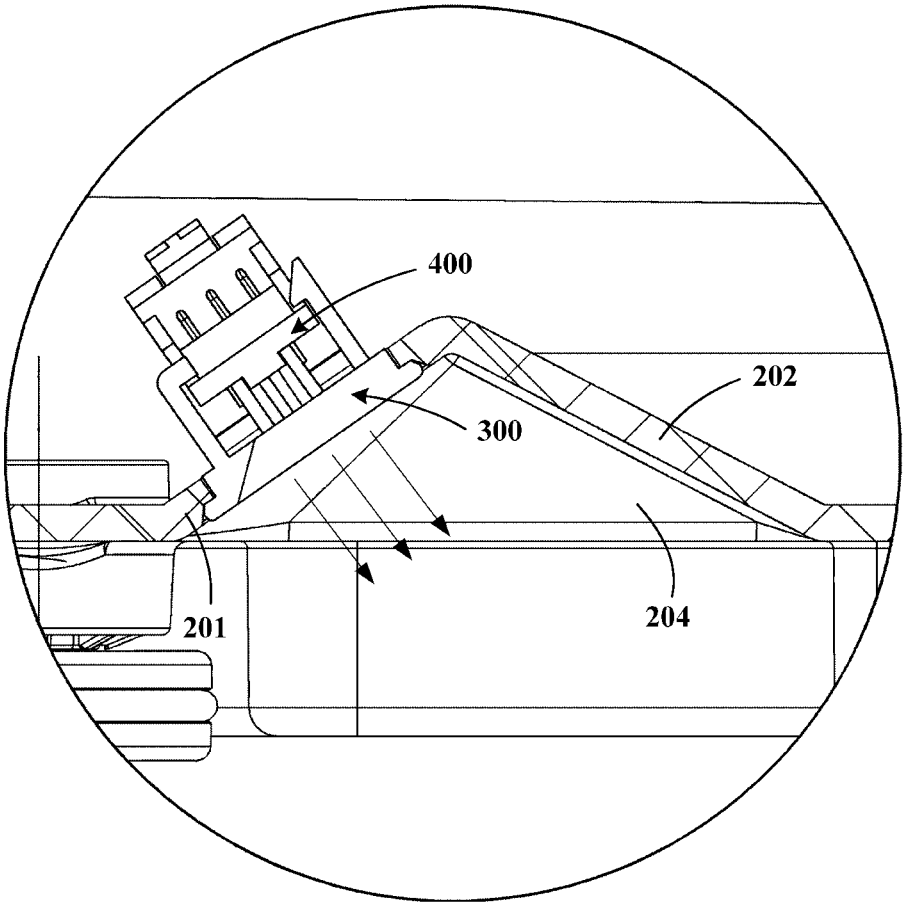
FIG. 6 is a schematic enlarged partial view of a portion B in FIG. 5.

FIG. 4 is a schematic front view of a side wall plate 200, a lampshade 300 and a lamp holder 400 of the refrigerator 100 shown in FIG. 2. FIG. 5 is a schematic cross-sectional view taken by a section line A-A in FIG. 4. FIG. 6 is a schematic enlarged partial view of a portion B in FIG. 5. The mounting of the light source 500 does not affect structures of other components as much as possible and does not affect the normal sliding of the drawer 130, and thus, in some embodiments, a concave structure 220 is formed on the slideway plate 200. The concave structure 220 is provided with a first inclined portion 201, a second inclined portion 202, a top surface portion 203, and a bottom surface portion 204. The first inclined portion 201 is disposed close to the front side of the drawer 130, and the second inclined portion 202 is disposed away from the front side of the drawer 130. The first inclined portion 201 and the second inclined portion 202 intersect, the top surface portion 203 is disposed at the tops of the two inclined portions, and the bottom surface portion 204 is disposed at the bottoms of the two inclined portions. The first inclined portion 201 is provided with a mounting opening 211, and the light source 500 is mounted on the first inclined portion 201.

In order to make the light emitted by the light source 500 emit out of the concave structure 220 as much as possible, the included angle between the first inclined portion 201 and the second inclined portion 202 is a right angle or an obtuse angle. In one preferred embodiment, the included angle between the first inclined portion 201 and the side wall of the drawer 130 is 35°-45°, and the light source 500 is disposed parallelly to the first inclined portion 201.

Figure 7:
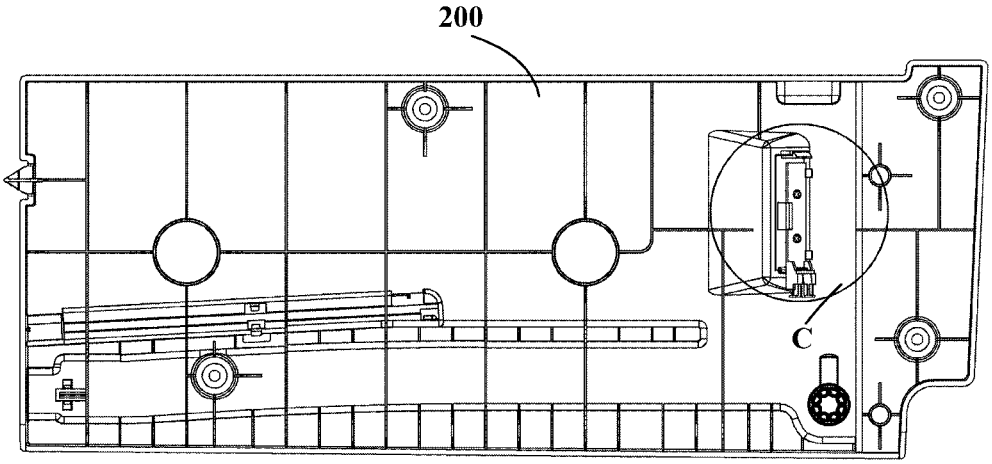
FIG. 7 is a schematic rear view of a side wall plate, a lampshade and a lamp holder of the refrigerator shown in FIG. 2.
Figure 8:
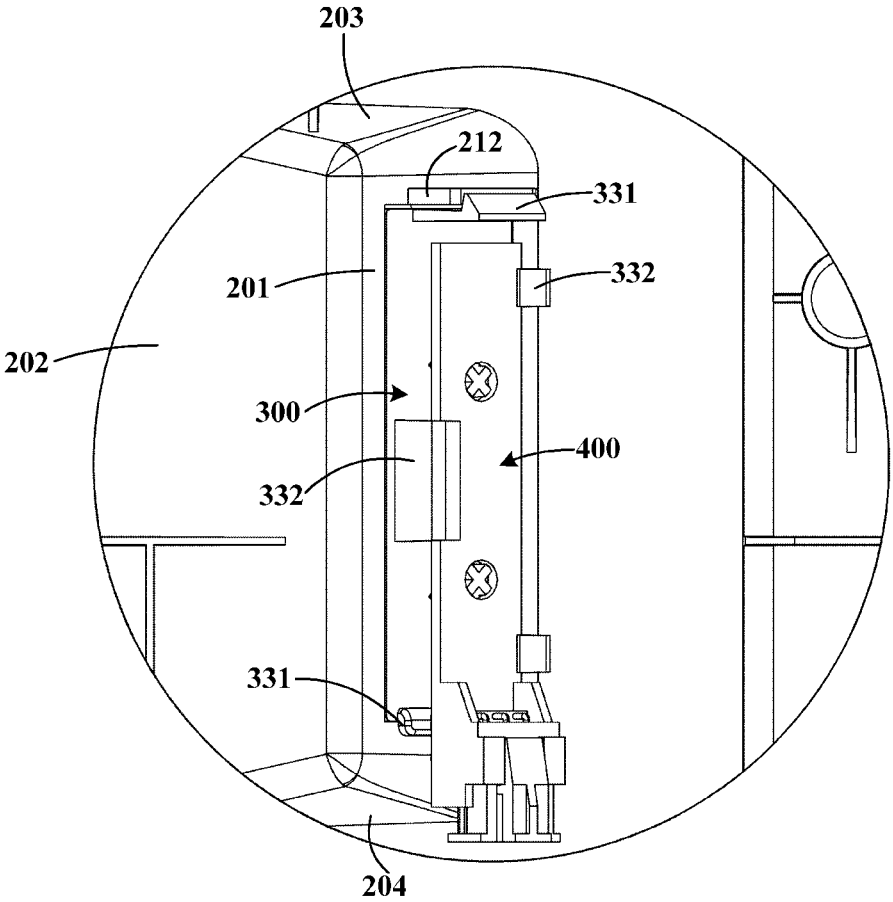
FIG. 8 is a schematic enlarged partial view of a portion C in FIG. 7.
Figure 9:
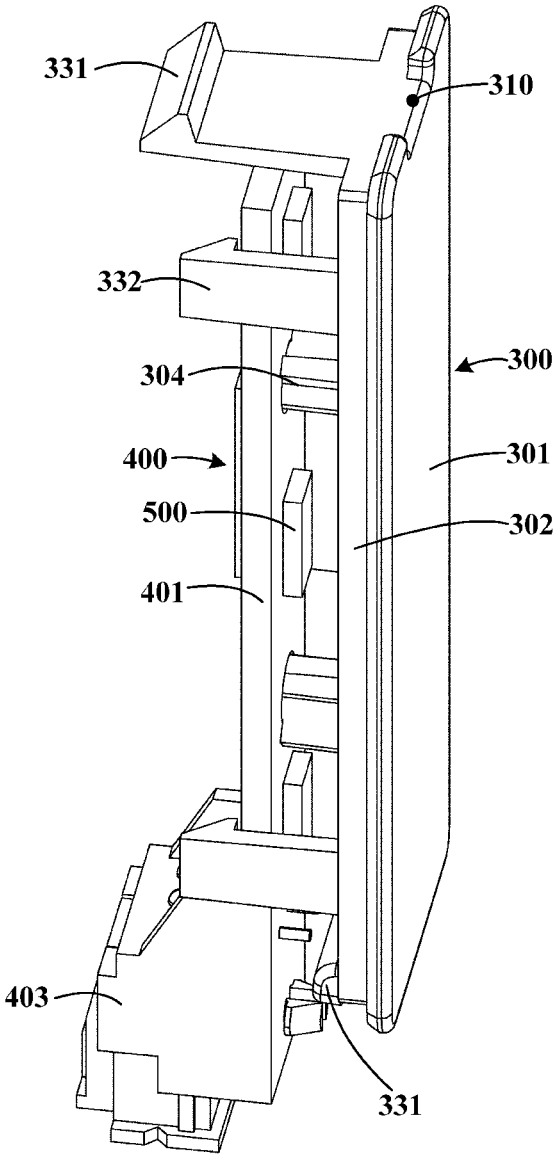
FIG. 9 is a schematic three-dimensional view of a lampshade and a lamp holder of the refrigerator shown in FIG. 2.

FIG. 7 is a schematic rear view of a side wall plate 200, a lampshade 300 and a lamp holder 400 of the refrigerator 100 shown in FIG. 2. FIG. 8 is a schematic enlarged partial view of a portion C in FIG. 7. FIG. 9 is a schematic three-dimensional view of a lampshade 300 and a lamp holder 400 of the refrigerator 100 shown in FIG. 2. The lamp shade 300 is provided with an inner-layer plate 302 and an outer-layer plate 301. The inner-layer plate 302 is disposed in the mounting opening 211, and the outer-layer plate 301 covers the mounting opening 211. The inner-layer plate 302 is fixed to the back surface of the first inclined portion 201.

In some embodiments, first clamping hooks 331 are formed by extending backwards from upper and lower sides of the back surface of the inner-layer plate 302 respectively. The shapes of the plurality of first hooks 331 may be the same or different. The top end of the first inclined portion 201 extends backwards to form a protrusion 212, and the first clamping hook 331 located on the upper portion is fixed to the protrusion 212 in a matched mode. And the first clamping hook 331 at the lower part is clamped at the edge of the mounting opening 211. In addition, in order to facilitate assembly and disassembly of the lamp shade 300, a notch 310 is provided in the top of the outer-layer plate 301.

In some embodiments, second clamping hooks 332 are formed by extending backwards from left and right sides of the back surface of the inner-layer plate 302 respectively. The shapes of the plurality of second hooks 332 may be the same or different. Meanwhile, a plurality of positioning columns 304 are formed by extending backwards from the area, between the plurality of second clamping hooks 332, of the inner-layer plate 302. The lamp holder 400 is formed with positioning holes 402 corresponding to the positioning columns 304. And the lamp holder 400 is fixed with the lamp shade 300 through the second clamping hooks 332, the positioning columns 304 and the positioning holes 402.

In some embodiments, each positioning column 304 includes a support portion 341 and a positioning portion 342. One end of the support portion 341 is the inner-layer plate 302, and the other end is the positioning portion 342. The positioning portions 342 fit within the positioning holes 402. The sizes of the support portions 341 are larger than the sizes of the positioning portions 342 so as to provide support between the lamp shade 300 and the lamp holder 400.

Figure 10:
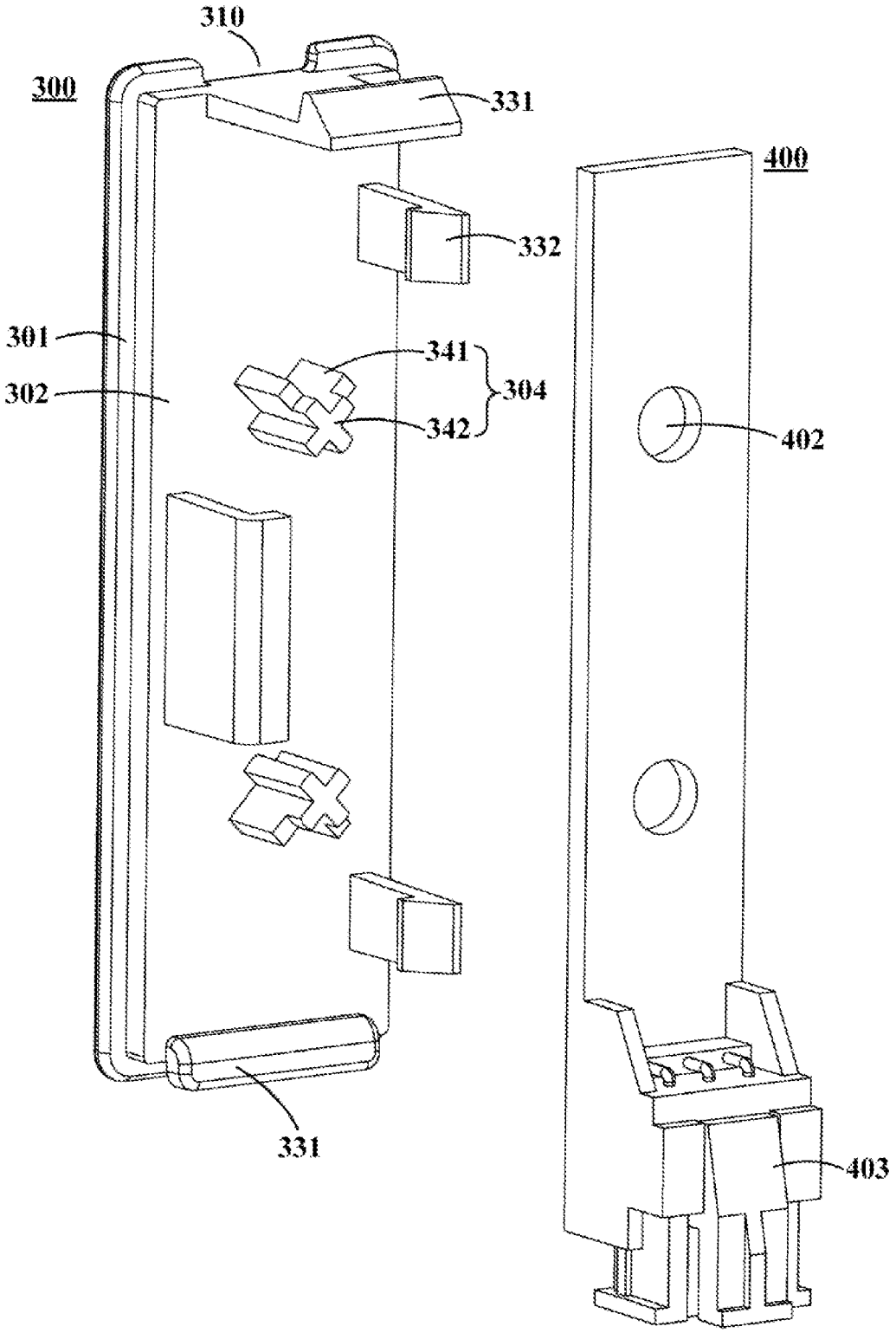
FIG. 10 is a schematic exploded view of a lampshade and a lamp holder of the refrigerator shown in FIG. 2.

FIG. 10 is a schematic exploded view of a lampshade 300 and a lamp holder 400 of the refrigerator 100 shown in FIG. 2. The lamp holder 400 includes a base body 401 and a control block 403. Positioning holes 402 are provided in the positions, corresponding to the positioning columns 304, of the base body 401. The base body 401 is provided with a plurality of light sources 500, for example, LED lamps, on a front surface. The control block 403 is disposed at the bottom of the base body 401, and the light sources 500 are controlled by the control block 403 to emit light or go out. Preferably, the control block 403 and the base body 401 are detachably and fixedly connected.

According to the refrigerator 100 provided by the embodiment of the present invention, the light source 500 is disposed on the side wall 114 of the cabinet 110, and the light emitted by the light source 500 obliquely propagates backwards inside the cabinet 110 to provide illumination for the storage compartment 140, so that the illumination for the storage compartment 140 is not affected by the shelf, and meanwhile, the light propagates backwards so that no dazzling occurs to the user's visual experience.

Hereto, those skilled in the art should realize that although multiple exemplary embodiments of the present invention have been illustrated and described in detail herein, however, without departing from the spirit and scope of the present invention, many other variations or modifications that conform to the principles of the present invention can still be directly determined or deduced from contents disclosed in the present invention. Therefore, the scope of the present invention should be understood and deemed as covering all these other variations or modifications.

The invention claimed is:

1. A refrigerator, comprising a cabinet, having at least one storage compartment defined therein, and having side walls; and a light source disposed on one of the side walls, and configured such that light emitted by the light source obliquely propagates backwards inside the cabinet, so as to provide illumination for the at least one storage compartment, wherein the refrigerator further comprises side wall plates detachably and fixedly connected with the side walls;

a concave structure is formed on one of the side wall plates, and has a first inclined portion, a second inclined portion, a top surface portion and a bottom surface portion, wherein the first inclined portion is disposed close to a front side of the cabinet, the second inclined portion is disposed away from the front side of the cabinet, the first inclined portion and the second inclined portion intersect, the top surface portion is disposed at respective top portions of the first inclined portion and the second inclined portion, and the bottom surface portion is disposed at respective bottom portions of the first inclined portion and the second inclined portion; wherein a mounting opening is provided in the first inclined portion; and the refrigerator further comprises:

a lampshade which is of a light-transmitting structure and fixed to the mounting opening; and a lamp holder fixed to the lampshade, an accommodating cavity being formed between the lamp holder and the lampshade, and the light source being disposed in the accommodating cavity, wherein the lampshade is provided with an inner-layer plate and an outer-layer plate directly opposite to each other, the inner-layer plate is disposed in the mounting opening, and the outer-layer plate covers the mounting opening;

the inner-layer plate is fixed to a back surface of the first inclined portion; and the lamp holder is fixed to a back surface of the inner-layer plate, and the accommodating cavity is formed therebetween.

2. The refrigerator according to claim 1, wherein the light source is configured such that an included angle between the light emitted and the one of the side walls is 45°-65°.

3. The refrigerator according to claim 1, wherein the light source is disposed close to a front end of the one of the side walls.

4. The refrigerator according to claim 1, wherein the side walls comprise a left side wall and a right side wall;

the light source is disposed on the left side wall and the right side wall of the at least one storage compartment respectively; and inclination angles of the light emitted by the light source positioned on the left side wall and the light source positioned on the right side wall meet the condition that the light on the two sides at least partially intersect, so that full illumination in a left-right direction of the storage compartment is realized.

5. The refrigerator according to claim 1, wherein the included angel between the first inclined portion and the second inclined portion is a right angle or an obtuse angle.

6. The refrigerator according to claim 1, wherein the lamp holder comprises a base body and a control block;

the light source is disposed on a front surface of the base body, the control block is disposed at the bottom; and the light source is controlled by the control block.

* * * * *